US008760363B2

(12) United States Patent
Lin et al.

(10) Patent No.: US 8,760,363 B2
(45) Date of Patent: Jun. 24, 2014

(54) SYSTEMS AND METHODS FOR SWITCHING BETWEEN AN ELECTRONIC PAPER DISPLAY AND A VIDEO DISPLAY

(75) Inventors: Gloria Lin, San Ramon, CA (US); Andrew Hodge, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 1246 days.

(21) Appl. No.: 12/572,204

(22) Filed: Oct. 1, 2009

(65) Prior Publication Data

US 2011/0080417 A1 Apr. 7, 2011

(51) Int. Cl.
*G09G 5/00* (2006.01)

(52) U.S. Cl.
USPC ..... 345/1.1; 345/1.2; 345/173; 345/204; 345/107; 455/566

(58) Field of Classification Search
USPC ..... 345/522, 107, 1.1–1.2, 561, 204, 173; 353/7–9, 11, 22, 10; 359/478, 22–26, 359/296; 455/566
See application file for complete search history.

(56) References Cited

U.S. PATENT DOCUMENTS

| | | | | |
|---|---|---|---|---|
| 6,054,071 | A * | 4/2000 | Mikkelsen, Jr. | 264/1.36 |
| 2002/0158812 | A1 | 10/2002 | Pallakoff | |
| 2003/0098845 | A1 * | 5/2003 | Hanson et al. | 345/156 |
| 2003/0231162 | A1 | 12/2003 | Kishi | |
| 2005/0052338 | A1 * | 3/2005 | Suzuki et al. | 345/1.1 |
| 2006/0187142 | A1 | 8/2006 | Lesniak | |
| 2007/0226762 | A1 * | 9/2007 | Girgis et al. | 725/33 |
| 2008/0068292 | A1 * | 3/2008 | Yuan et al. | 345/2.1 |
| 2008/0072163 | A1 | 3/2008 | Teng et al. | |
| 2008/0192013 | A1 * | 8/2008 | Barrus et al. | 345/173 |
| 2008/0309648 | A1 * | 12/2008 | Erol et al. | 345/204 |

FOREIGN PATENT DOCUMENTS

| | | | |
|---|---|---|---|
| EP | 1826739 | A1 | 8/2007 |
| WO | 2006097865 | A2 | 9/2006 |
| WO | 2008065610 | A2 | 6/2008 |
| WO | 2008084549 | A1 | 7/2008 |

* cited by examiner

*Primary Examiner* — Lun-Yi Lao
*Assistant Examiner* — Shaheda Abdin
(74) *Attorney, Agent, or Firm* — David C. Kellogg

(57) ABSTRACT

Systems and methods for switching between an electronic paper display and a video display are provided. Control circuitry in an electronic device can analyze visual content to determine one or more features of the visual content. For example, the control circuitry can analyze visual content to determine the rate of change and/or color composition of the visual content. Based on the one or more features, the control circuitry can selectively enable the device's electronic paper display or the device's video display.

20 Claims, 11 Drawing Sheets

SYSTEMS AND METHODS FOR SWITCHING BETWEEN AN ELECTRONIC PAPER DISPLAY AND A VIDEO DISPLAY

BACKGROUND OF THE INVENTION

This is directed to electronic devices with multiple displays. In particular, this is directed to systems and methods for displaying visual content on a combination of electronic paper and video displays.

Traditional electronic devices include a single display for outputting visual content. For example, a traditional device may include a liquid crystal display (LCD) or organic light-emitting diode (OLED) display for outputting color visual content. In another example, a traditional device may include an electronic paper display for outputting black-and-white visual content using minimal power. The type of display included in a traditional electronic device is typically based on an assumption about the visual content it will most often display because different types of displays may be optimal, in performance or efficiency, for different types of visual content. For example, an LCD or OLED display may be optimal for high-resolution or dynamic color content while an electronic paper display may be optimal for relatively static black-and-white content. However, a traditional device may display multiple types of visual content even though its display may only be optimal for a single type of visual content.

SUMMARY OF THE INVENTION

This is directed to systems and methods for switching between an electronic paper display and a video display based on at least one feature of visual content.

Control circuitry in an electronic device can analyze visual content to determine one or more features of the visual content. For example, the control circuitry can analyze visual content to determine the rate of change and/or color composition of the visual content. Based on the one or more features, the control circuitry can selectively enable the device's electronic paper display or the device's video display.

In some embodiments, portions of a device's electronic paper display and video display may be selectively enabled based on the visual content to be displayed in that portion. For example, an electronic device may divide visual content into different segments (e.g., different regions of a screen), analyze each segment, and then selectively enable a combination of electronic paper display regions and video display regions based on the visual content of each segment.

In some embodiments, the electronic paper display and the video display may each be stacked vertically. For example, the electronic paper display can be stacked over the video display or the video display can be stacked over the electronic paper display. In some embodiments, an electronic device may direct the electronic paper display or the video display to configure itself to be translucent. For example, if an electronic paper display is stacked over a video display and the video display is selectively enabled, the electronic display may direct the electronic paper display to configure itself into a translucent state so that the video display is visible.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

Figure 1:
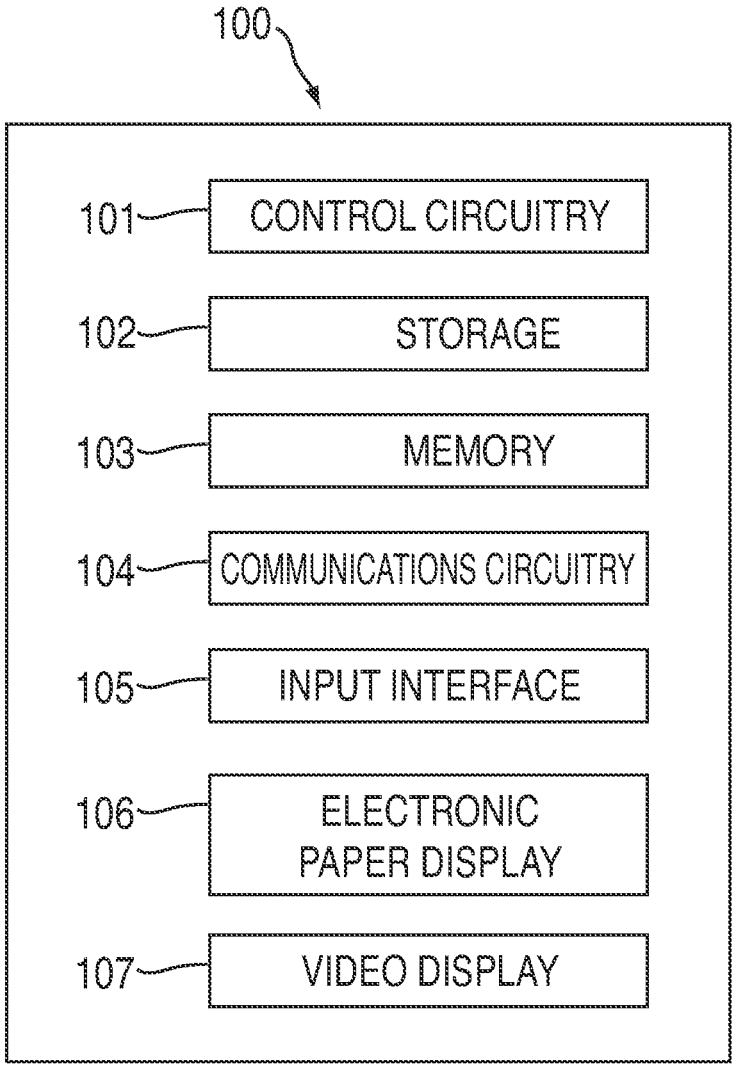
FIG. 1 is a simplified block diagram of an illustrative electronic device for switching between electronic paper and video displays in accordance with one embodiment of the invention.

This is directed to systems and methods for switching between electronic paper and video displays in an electronic device based on at least one feature of visual content. FIG. 1 is a block diagram of an illustrative electronic device for switching between an electronic paper display and a video display in accordance with one embodiment of the invention. For example, electronic device 100 can switch between an electronic paper and a video display based on at least one feature of visual content. Electronic device 100 can include control circuitry 101, storage 102, memory 103, communications circuitry 104, input interface 105, electronic paper display 106, and video display 107. In some embodiments, one or more of the components of electronic device 100 can be combined or omitted. For example, storage 102 and memory 103 can be combined into a single mechanism for storing data. In some embodiments, electronic device 100 can include other components not combined or included in those shown in FIG. 1, such as a power supply (e.g., a battery or kinetics) or a bus. In some embodiments, electronic device 100 can include several instances of the components shown in FIG. 1 but, for the sake of simplicity, only one of each of the components is shown in FIG. 1.

Electronic device 100 can include any suitable type of electronic device operative to play back music. For example, electronic device 100 can include a media player such as an iPod® available from Apple Inc., of Cupertino, California, a cellular telephone, a personal e-mail or messaging device (e.g., a Blackberry® or a Sidekick®), an iPhone® available from Apple Inc., pocket-sized personal computers, personal digital assistants (PDAs), a laptop computer, a cyclocomputer, a music recorder, a video recorder, a camera, and any other suitable electronic device. In some cases, electronic device 100 can perform a single function (e.g., a device dedicated to playing music) and in other cases, electronic device 100 can perform multiple functions (e.g., a device that plays music, displays video, stores pictures, and receives and transmits telephone calls).

Control circuitry 101 can include any processing circuitry or processor operative to control the operations and performance of an electronic device of the type of electronic device 100. Storage 102 and memory 103, which can be combined can include, for example, one or more storage mediums or memory used in an electronic device of the type of electronic device 100. In particular, storage 102 and memory 103 can store visual content and/or information related to visual content stored such as the rate of change or color composition of the visual content.

Communications circuitry 104 can include any suitable communications circuitry operative to connect to a communications network and to transmit communications (e.g., voice or data) from device 100 to other devices within the communications network. Communications circuitry 104 can be operative to interface with the communications network using any suitable communications protocol such as, for example, Wi-Fi (e.g., a 802.11 protocol), Bluetooth®, radio frequency systems (e.g., 900 MHz, 1.4 GHz, and 5.6 GHz communication systems), cellular networks (e.g., GSM, AMPS, GPRS, CDMA, EV-DO, EDGE, 3GSM, DECT, IS-136/TDMA, iDen, LTE or any other suitable cellular network or protocol), infrared, TCP/IP (e.g., any of the protocols used in each of the TCP/IP layers), HTTP, BitTorrent, FTP, RTP, RTSP, SSH, Voice over IP (VOIP), any other communications protocol, or any combination thereof. In some embodiments, communications circuitry 104 can be operative to provide wired communications paths for electronic device 100.

Input interface 105 can include any suitable mechanism or component for receiving inputs from a user. In some embodiments, input interface 105 can include a touch interface for receiving touch inputs from a user. For example, input interface 105 can include a capacitive touch assembly for receiving touch inputs from a user. In some embodiments, input interface 105 can include a touch interface for receiving touch inputs from a user that include multi-touch gestures. Input interface 105 can also include circuitry operative to convert (and encode/decode, if necessary) analog signals and other signals into digital data, for example in any manner typical of an electronic device of the type of electronic device 100.

Electronic paper display 106 may include any suitable electronic ink display. In some embodiments, electronic paper display 106 may include an electronic paper display incorporating E Ink available from E Ink Corporation of Cambridge, Mass. Electronic paper display 106 may include individually addressable microcapsules (e.g., microglobules), and each microcapsule may contain particles of different colors. For example, each microcapsule may contain white and black particles suspended in a fluid. Particles of different colors may have different charges, and the particles within a microcapsule may be configured by applying a charge to the microcapsule. For example, applying a negative electric charge under a microcapsule may repel all positively charged particles in the microcapsule to the top of the microcapsule, and the microcapsule may appear to be the color of the positively charged particles. In some embodiments, electronic paper display 106 may be configured to be translucent. A more detailed discussion of techniques for configuring an electronic paper display to be translucent can be found in connection with the description of FIGS. 4-6.

Electronic paper display 106 can display visual content in black-and-white or grayscale. In some embodiments, electronic paper display 106 can display visual content in color. Electronic paper display 106 can display visual content at any suitable brightness level or resolution. In some embodiments, the brightness level or resolution of electronic paper display 106 can be adjusted by a user (e.g., through display configuration options). Electronic paper display 106 can be electrically coupled with control circuitry 101, storage 102, memory 103, any other suitable components within device 100, or any combination thereof. Electronic paper display 106 can display visual content stored in device 100 (e.g., stored in storage or memory in the device) or generated by device 100 (e.g., generated by a processor in the device).

In some embodiments, portions of electronic paper display 106 may be independently enabled. For example, portions of display 106 may be activated to provide visual content while other portions of the display may be configured to be translucent. In some embodiments, electronic paper display 106 may include multiple regions that can be independently enabled. For example, a region of display 106 may be disposed at a particular location of the display, and that region may provide a segment of visual content corresponding to that location (e.g., lower right-hand corner). In some embodiments, electronic paper display 106 may include a single panel that has been divided into regions for controlling the display. In other embodiments, electronic paper display 106 may include multiple panels and each panel may correspond to a region of the display.

Video display 107 can include any suitable component for displaying dynamic visual content in color (e.g., videos). For example, video display 107 can include a thin-film transistor liquid crystal display (LCD), an organic liquid crystal display (OLCD), a plasma display, a surface-conduction electron-emitter display (SED), organic light-emitting diode display (OLED), or any other suitable type of display. In some embodiments, video display 107 can include an active-matrix display for controlling individual pixels. In some embodiments, video display 107 may not require a backlight to be visible. For example, video display 107 can include an OLED display that does not require a backlight. Video display 107 can display visual content in black-and-white, color, or a combination of the two. Video display 107 can display visual content at any suitable brightness level or resolution. In some embodiments, the brightness level or resolution of video display 107 can be adjusted by a user (e.g., through display configuration options). Video display 107 can be electrically coupled with control circuitry 101, storage 102, memory 103, any other suitable components within device 100, or any combination thereof. Video display 107 can display visual content stored in device 100 (e.g., stored in storage or memory in the device) or generated by device 100 (e.g., generated by a processor in the device).

In some embodiments, portions of video display 107 may be independently enabled. For example, portions of display 107 may be activated to provide visual content while other portions of the display remain inactive. In some embodiments, it may be advantageous for video display 107 to operate without a backlight so that select portions of the display can be enabled without illuminating the entire display. For example, video display 107 may include an OLED display that can selectively enable individual pixels of a display without applying a backlight to the entire display. In some embodiments, video display 107 may include multiple regions that can be independently enabled. For example, a region of video display 107 may be disposed at a particular location of the display, and that region may provide a segment of visual content corresponding to that location (e.g., lower right-hand corner). In some embodiments, video display 107 may include a single panel that has been divided into regions for controlling the display. In other embodiments, video display 107 may include multiple panels with independently activated backlights, and each panel may correspond to a region of the display.

Figure 2A:
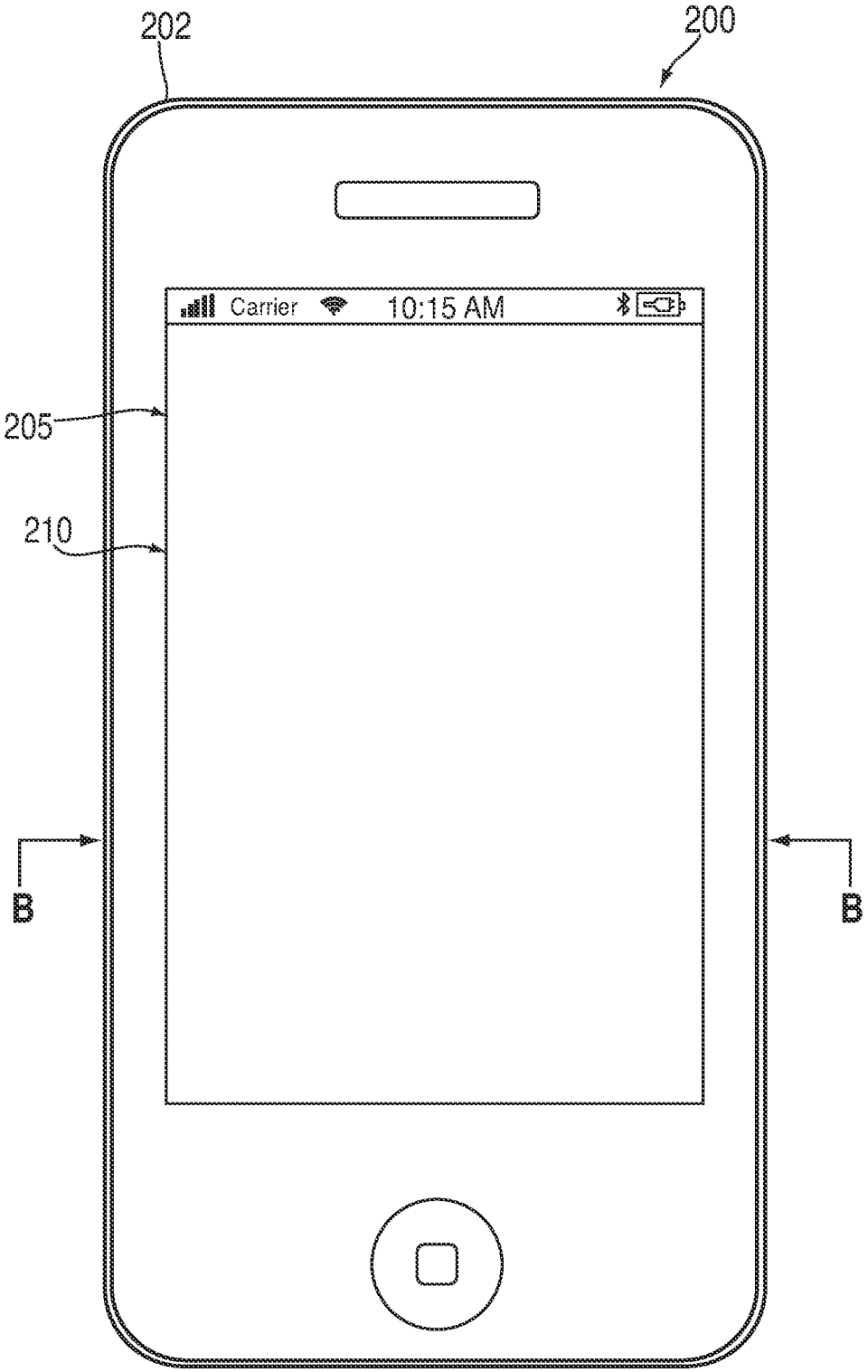
FIGS. 2A and 2B are schematic views of an illustrative electronic device for switching between electronic paper and video displays in accordance with one embodiment of the invention.
Figure 2B:
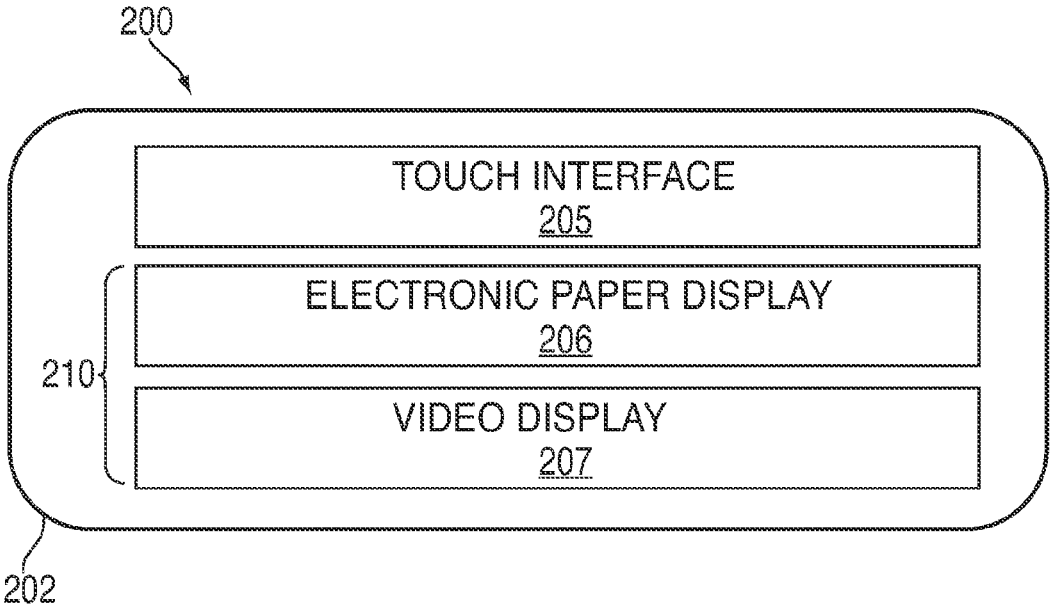

As previously described, an electronic device can switch between an electronic paper display and a video display based on one or more features of visual content. For example, a device can display visual content with a low rate of change and/or simple color composition on an electronic paper display and visual content with a high rate of change or detailed color composition on a video display. FIGS. 2A and 2B are, respectively, a schematic view and a cross-sectional view of device 200 for switching between an electronic paper display and a video display in accordance with one embodiment of the invention. Device 200 may include any suitable electronic device with an electronic paper display and a video display (see, e.g., device 100 shown in FIG. 1). Device 200 may include housing 202 and one or more mechanisms, components, or circuitry interior to or embedded in housing 202 (see, e.g., control circuitry 101, storage 102, memory 103, communications circuitry 104, input interface 105, electronic paper display 106, and video display 107, all of which are shown in FIG. 1).

Device 200 can include composite display 210 for presenting visual content to a user. Composite display 210 can be electrically coupled with control circuitry in device 200 (see, e.g., control circuitry 101 shown in FIG. 1). For example, composite display 210 can be electrically coupled with graphics circuitry or a processor in device 200. Composite display 210 can display visual content that is stored in device 200 (e.g., stored in storage or memory in the device) or generated by device 200 (e.g., generated by a processor in the device). Composite display 210 can include multiple displays based on different technologies. For example, composite display 210 can include electronic paper display 216 (see, e.g., electronic paper display 106 shown in FIG. 1) and video display 217 (see, e.g., video display 107 shown in FIG. 1). In some embodiments, at least a portion of electronic paper display 206 may be stacked over video display 207 (see, e.g., FIG. 2B). For example, at least a portion of electronic paper display 206 may overlap video display 207. In such embodiments, device 200 can configure electronic paper display 206, or a portion thereof, to be translucent when video display 207 is providing visual content. For example, when video display 207 is providing visual content, device 200 may configure at least the portion of electronic paper display 206 that overlaps the visual content to be translucent. In some embodiments, electronic paper display 206 may overlap all of video display 207. In such embodiments, device 200 may configure the entire electronic paper display 206 to be translucent when video display 207 is providing visual content.

Composite display 210 can be any suitable shape. For example, composite display 210 may be a rectangular shape (e.g., having a 16:9 aspect ratio). In some embodiments, device 200 may also include an input interface for receiving user inputs (see, e.g., input interface 105). For example, device 200 can include touch interface 205 for use in conjunction with composite display 210. Continuing the example, touch interface 205 may be translucent and may overlap at least a portion of composite display 210. The combination of composite display 210 and touch interface 205 can form a touch screen that can both display visual content to a user and receive touch inputs from the user.

In some embodiments, device 200 can switch between electronic paper display 206 and video display 207 based on at least one feature of visual content. For example, device 200 may analyze visual content to determine one or more feature of the visual content and then, based on the determined one or more feature, display the visual content on electronic paper display 206, video display 207, or a combination thereof. As previously described, features of visual content can include any suitable features. In some embodiments, a device can switch between an electronic paper display and a video display based on at least one feature that includes the color composition of the content. For example, when visual content has a simple color composition, device 200 can provide the visual content through electronic paper display 206 (e.g., in black-and-white or grayscale). Continuing the example, when visual content has a complex color composition, device 200 can provide the visual content through video display 207 (e.g., in robust color). In this manner, device 200 can provide visual content on a display appropriate for the color composition of the content. In some embodiments, a device can switch between an electronic paper display and a video display based on at least one feature that includes the content's rate of change. For example, when visual content has a low rate of change (e.g., relatively static content such as text), device 200 can provide the visual content through electronic paper display 206. Continuing the example, when visual content has a high rate of change (e.g., relatively dynamic content such as video), device 200 can provide the visual content through video display 207.

Figure 3:
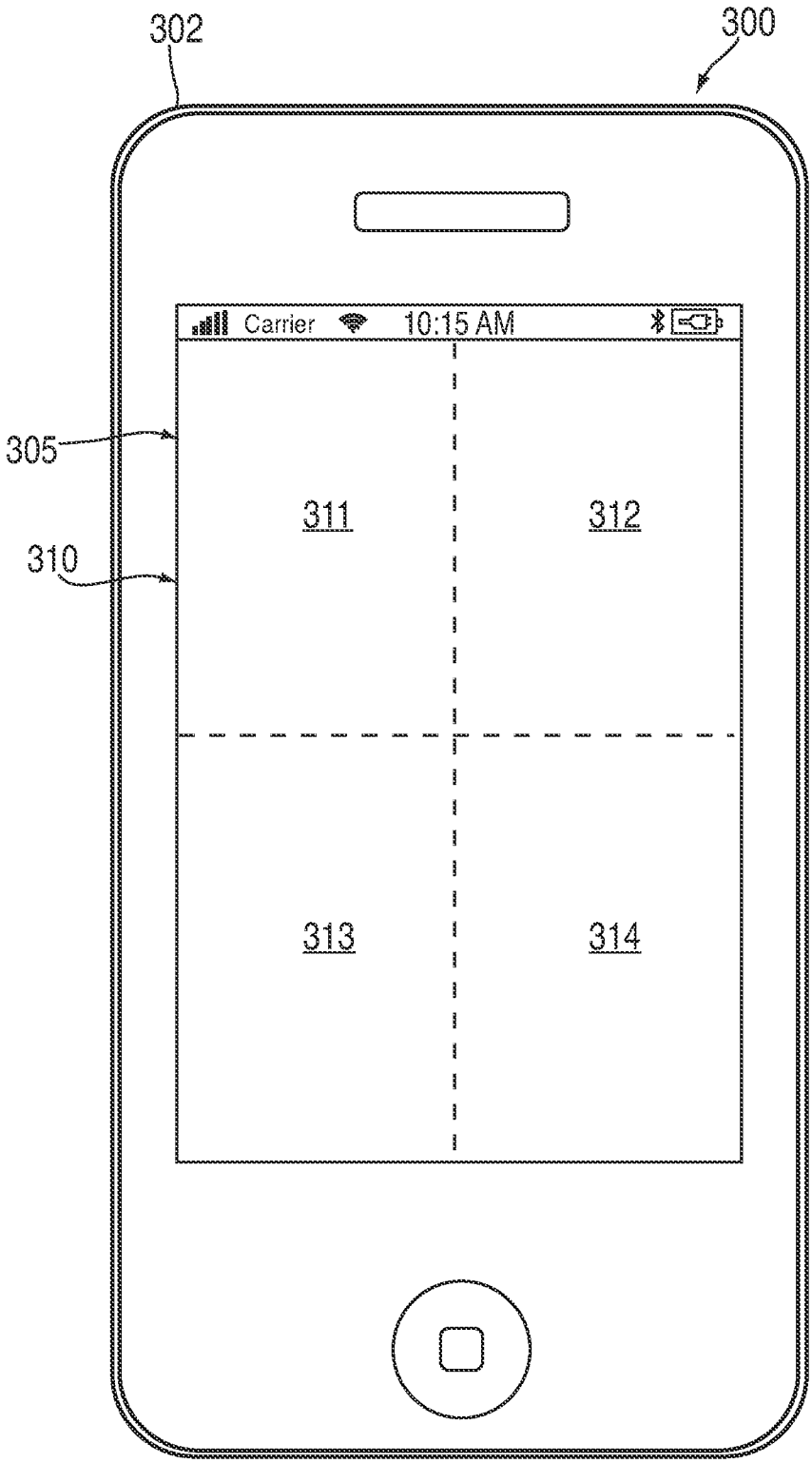
FIG. 3 is a schematic view of an illustrative electronic device for switching between electronic paper and video displays in accordance with one embodiment of the invention.

In some embodiments, a composite display may include regions that can be independently switched between a portion of an electronic paper display and a portion of a video display. For example, a composite display may be divided into quadrants and each quadrant may be independently switching between a corresponding region of an electronic paper display and a corresponding region of a video display. FIG. 3 is a schematic view of device 300 for switching between an electronic paper display and a video display in accordance with one embodiment of the invention. Device 300 may include any suitable electronic device with an electronic paper display and a video display (see, e.g., device 100 shown in FIG. 1). Device 300 may include housing 302 and one or more mechanisms, components, or circuitry interior to or embedded in housing 302 (see, e.g., control circuitry 101, storage 102, memory 103, communications circuitry 104, input interface 105, electronic paper display 106, and video display 107, all of which are shown in FIG. 1). In some embodiments, device 300 can include touch interface 305 (see, e.g., input interface 105 shown in FIG. 1 and touch interface 205 shown in FIGS. 2A and 2B) for receiving user inputs.

Device 300 can include composite display 310 with multiple composite display regions. For example, composite display 310 can include composite display regions 311-314. Each of composite display regions 311-314 can include an electronic paper display region and a corresponding video display region. For example, composite display 310 can include an electronic paper display (see, e.g., electronic paper display 106 shown in FIG. 1 and electronic paper display 206 shown in FIG. 2B) and a video display (see, e.g., video display 107 shown in FIG. 1 and video display 207 shown in FIG. 2B). Accordingly, each of composite display regions 311-314 may include a portion of the electronic paper display and a corresponding portion of the video display. Composite display regions 311-314 may be independently switched between the corresponding portion of the electronic paper display and the corresponding portion of the video display based on one or more features of visual content. In some embodiments, device 300 may determine one or more features of different segments of visual content, whereby each segment corresponds to one of composite display regions 311-314. For example, device 300 may determine a feature of an upper left-hand segment of visual content and then direct composite display region 311 to provide the segment through either an electronic paper display or a video display based on the determined feature. In this manner, each of composite display regions 311-314 can display visual content through either a portion of an electronic paper display or a portion of a video display based on one or more features of the corresponding segment of visual content.

In some embodiments, composite display regions 311-314 may include separate panels for selectively enabling a video display. For example, a video display can include multiple panels, and each panel can correspond to one of composite display regions 311-314. In some embodiments, a video display may include multiple panels with independently activated backlights. Accordingly, a video display that requires a backlight for illumination can be divided into different panels and each panel can be selectively enabled without illuminating the other panels. In some embodiments, both an electronic paper display and a video display can be divided into panels. In other embodiments, an electronic paper display can be a single panel with multiple regions while a video display may be divided into panels.

While the embodiment shown in FIG. 3 includes four composite display regions that each correspond to a quadrant of the composite display, it is understood that any suitable number of composite display regions or configuration of composite display regions can be implemented in accordance with the disclosure. For example, a composite display may include three composite display regions and each composite display region may extend from the left side of the display to the right side of the display while covering a third of the vertical height of the display. In other embodiments, a composite display may include 16, 64 or 256 composite display regions that are arranged in a grid.

In some embodiments, an electronic device can configure an electronic paper display or a portion of an electronic paper display to be translucent. For example, an electronic device can configure an electronic paper display or a portion thereof to transmit at least 50% of the light incident on the display, at least 60% of the light incident on the display, at least 70% of the light incident on the display, at least 80% of the light incident on the display, at least 90% of the light incident on the display, 100% of the light incident on the display, or any other suitable amount of light incident on the display. An electronic device can configure an electronic paper display or a portion thereof to be translucent so that a user can see visual content provided by a video display under the electronic paper display (see, e.g., video display 207 under electronic paper display 206, both of which are shown in FIG. 2B). An electronic device can configure an electronic paper display or a portion thereof to be translucent using any suitable technique.

In some embodiments, an electronic paper display can be configured to be translucent by changing the state of material in the display. An electronic paper display may include individually addressable microcapsules, each of which can include particles of different colors, and the particles may have different properties depending on the state of the particles. For example, the particles may appear a particular color in a solid state (e.g., white or black) but appear translucent in a gaseous state. In such embodiments, the electronic paper display or a portion thereof may be configured to be translucent by changing the state of the particles. For example, an electronic paper display can heat particles to convert them from solid to gas and, therefore, configure the electronic paper display to be translucent.

Figure 4A:
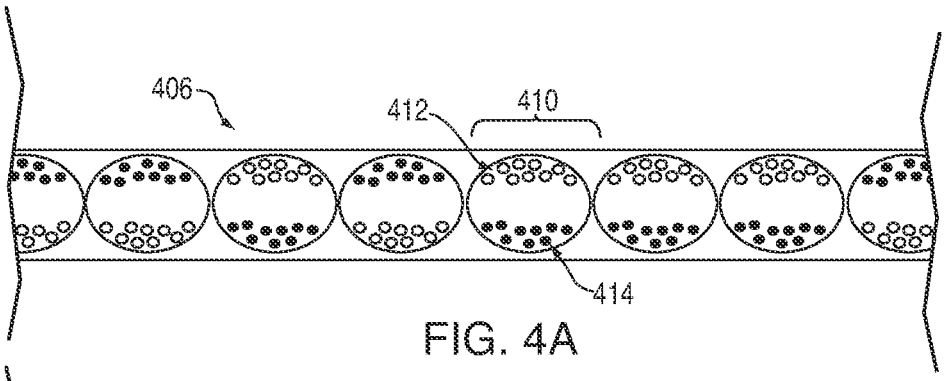
FIGS. 4A and 4B are cross-sectional views of an illustrative electronic paper display in accordance with one embodiment of the invention.
Figure 4B:
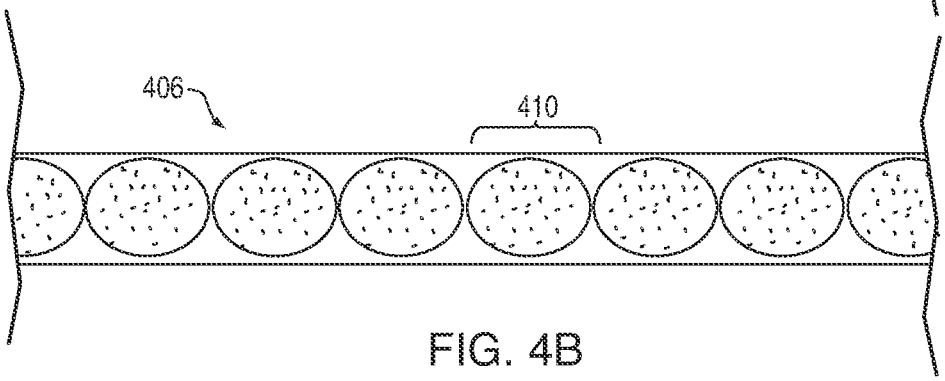

FIGS. 4A and 4B are cross-sectional views of electronic paper display 406 that can be configured to be translucent in accordance with one embodiment of the invention. Display 406 may include any suitable electronic paper display (see, e.g., electronic paper display 106 shown in FIG. 1). Display 406 may be located within or embedded in the housing of an electronic device (see, e.g., housing 202 shown in FIGS. 2A and 2B). Electronic paper display 406 may overlap at least a portion of a video display (see, e.g., electronic paper display 206 and video display 207, both of which are shown in FIG. 2B). Electronic paper display 406 may be located adjacent to a touch interface (see, e.g., touch interface 205 shown in FIGS. 2A and 2B) and the combination of the touch interface and display 406 may function as a touch screen.

As shown in FIG. 4A, electronic paper display 406 can include microcapsules with charged particles. Each microcapsule in display 406 may contain white and black particles suspended in a fluid. For example, microcapsule 410 may include white particles 412 and black particles 414. Particles of different colors may have different charges, and the particles within a microcapsule may be configured by applying a charge to the microcapsule. For example, white particles 412 may have a positive charge and display 406 may apply a positive electrical charge at the bottom of microcapsule 410 to repel white particles 412 to the top of microcapsule 410. In this example, microcapsule 410 may appear as a white pixel to a user.

In some situations, a device may configure electronic paper display 406 or a portion thereof to be translucent. For example, a device may configure electronic paper display 406 to be translucent if a video display underneath display 406 is providing visual content (see, e.g., video display 207 underneath electronic paper display 206, both of which are shown in FIG. 2B). As shown in FIG. 4B, electronic paper display 406 may be configured to be translucent by changing the state of material in the display. For example, the state of particles 412 and 414, as well as other particles in other microcapsules, can be changed to gas and render the display translucent. The state of particles in an electronic paper display can be changed using any suitable technique. In some embodiments, display 406 may generate heat to change the state of the particles in the display. For example, display 406 may generate heat using any suitable technique to change particles 412 and 414 to a gaseous state that is translucent. In some embodiments, display 406 may generate heat by applying a relatively high voltage to the microcapsules so that a substantial amount of current passes through the microcapsules. In some embodiments, display 406 may generate heat by operating an induction heater located near the microcapsules. In some embodiments, an electronic paper display that has been configured to be translucent may be selectively enabled by removing heat. For example, display 406 may remove heat using any suitable technique to return the display's particles to a solid state for providing visual content. In some embodiments, display 406 may remove heat by applying a heat sink to the display's microcapsules.

In some embodiments, an electronic paper display can be configured to be translucent by moving the display's microcapsules. As previously discussed, an electronic paper display can include multiple microcapsules with colored particles (see, e.g., electronic paper display 106 shown in FIG. 1 and electronic paper display 406 shown in FIG. 4A). In some embodiments, the display's microcapsules can be moved to a storage area to configure the display to be translucent.

Figure 5A:
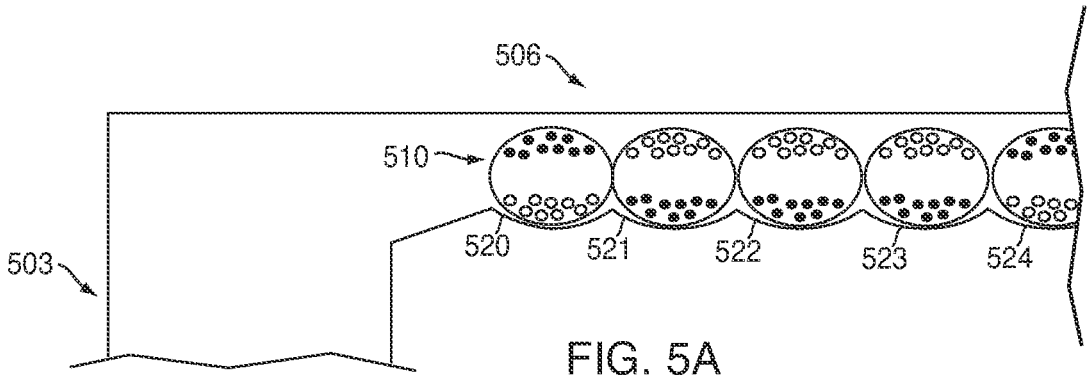
FIGS. 5A and 5B are cross-sectional views of an illustrative electronic paper display in accordance with one embodiment of the invention.
Figure 5B:
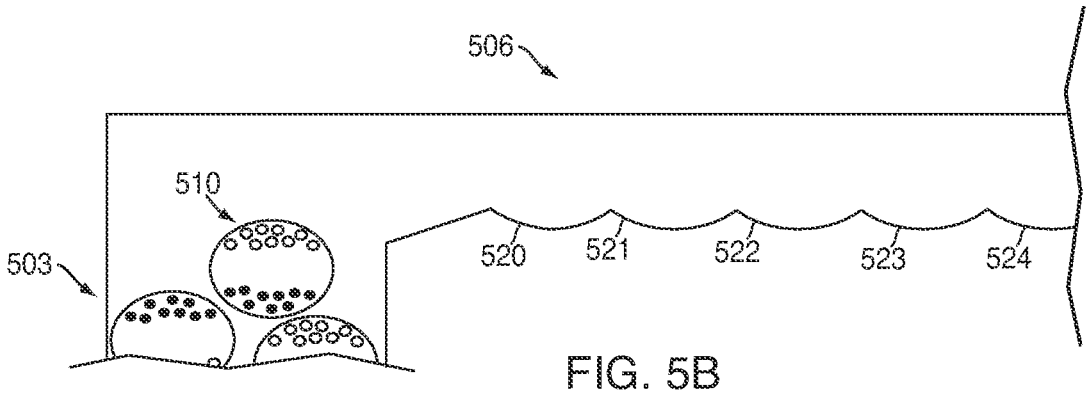

FIGS. 5A and 5B are cross-sectional views of electronic paper display 506 that can be configured to be translucent in accordance with one embodiment of the invention. Display 506 may include any suitable electronic paper display (see, e.g., electronic paper display 106 shown in FIG. 1). Display 506 may be located within or embedded in the housing of an electronic device (see, e.g., housing 202 shown in FIGS. 2A and 2B). Electronic paper display 506 may overlap at least a portion of a video display (see, e.g., electronic paper display 206 and video display 207, both of which are shown in FIG. 2B). Electronic paper display 506 may be located adjacent to a touch interface (see, e.g., touch interface 205 shown in FIGS. 2A and 2B) and the combination of the touch interface and display 506 may function as a touch screen.

Electronic paper display 506 can include microcapsules with charged particles. For example, display 506 can include microcapsule 510 with charged particles (see, e.g., microcapsule 410 shown in FIG. 4). In some embodiments, an electronic paper display may include concave surfaces for aligning microcapsules. For example, display 506 may include concave surfaces 521-524 and each of the concave surfaces may be shaped to accept a microcapsule. In some embodiments, electrical conductors may be integrated into concave surfaces 521-524 so that microcapsules can be electrically charged to change their appearance. Electronic paper display 506 can also include storage area 503 for storing microcapsules. As shown in FIG. 5B, display 506 can be configured to be translucent by moving microcapsules in the display to storage area 503. For example, microcapsule 510 can be moved from concave surface 511 to storage area 503. Microcapsules in an electronic paper display can be moved using any suitable technique. In some embodiments, microcapsules in display 506 can be moved using a mechanical force. For example, a structure can push microcapsules into storage area 503. In another example, pressurized air can push microcapsules into storage area 503. In some embodiments microcapsules in display 506 can be moved using a magnetic force. For example, a relatively strong magnetic field can be applied to repel or attract microcapsules into storage area 503. In some embodiments, an electronic paper display that has been configured to be translucent may be selectively enabled by moving the display's microcapsules back into active position. For example, microcapsules in display 506 may be moved into active position using any suitable technique. As previously discussed, microcapsules in display 506 may be moved using a mechanical or magnetic force and, in some embodiments, the same technique used to move the microcapsules into storage area 503 may also be used to restore the microcapsules to their previous location. In some embodiments, concave surfaces 521-524 may be similarly shaped so that each surface can accept any microcapsule in display 506. In such embodiments, microcapsules can be moved back into active position without necessarily returning to the same concave surface. For example, microcapsule 510 can be moved into any of surfaces 520-524 when display 506 is enabled.

In some embodiments, display 506 may be vibrated to assist the movement of microcapsules in the display. For example, display 506 may be vibrated to assist the movement of microcapsules from concave surfaces 520-524 to storage area 503 or from storage area 503 to concave surfaces 520-524. For example, a device may include a vibrator (e.g., for providing "silent" telephone alerts) and that vibrator may be activated to assist the movement of microcapsules in the electronic paper display.

In some embodiments, an electronic paper display can be configured to be translucent by pulling particles within the display's microcapsules to the side. As previously discussed, an electronic paper display can include multiple microcapsules with colored particles (see, e.g., electronic paper display 106 shown in FIG. 1 and electronic paper display 406 shown in FIG. 4A). In some embodiments, an electronic paper display's microcapsules may be elongated to create relatively large side walls and the colored particles in the display's microcapsules can be moved to the side of the microcapsules to configure the display to be translucent.

Figure 6A:
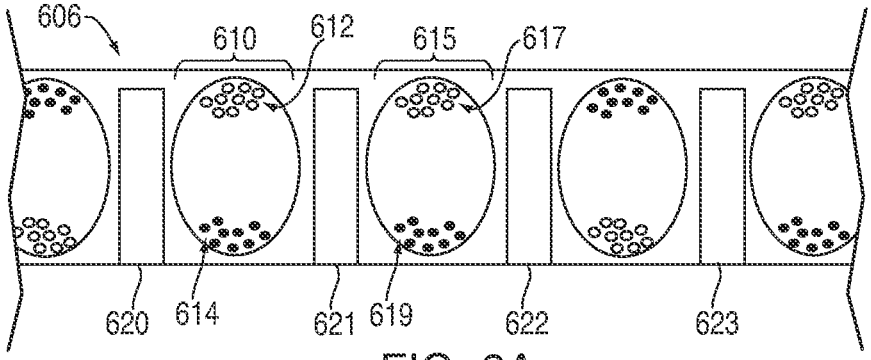
FIGS. 6A and 6B are cross-sectional views of an illustrative electronic paper display in accordance with one embodiment of the invention.
Figure 6B:
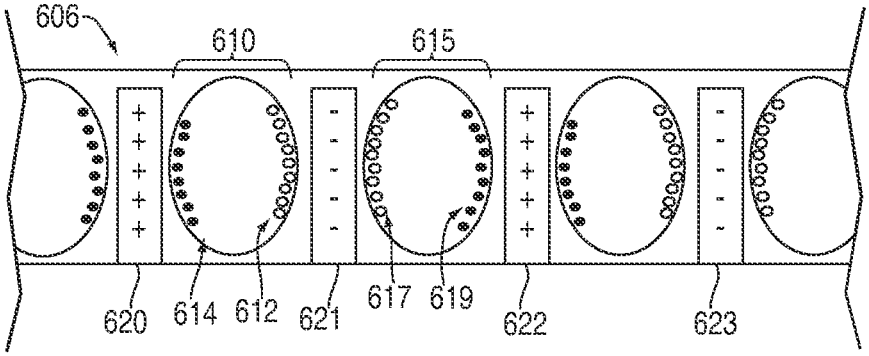

FIGS. 6A and 6B are cross-sectional views of electronic paper display 606 that can be configured to be translucent in accordance with one embodiment of the invention. Display 606 may include any suitable electronic paper display (see, e.g., electronic paper display 106 shown in FIG. 1). Display 606 may be located within or embedded in the housing of an electronic device (see, e.g., housing 202 shown in FIGS. 2A and 2B). Electronic paper display 606 may overlap at least a portion of a video display (see, e.g., electronic paper display 206 and video display 207, both of which are shown in FIG. 2B). Electronic paper display 606 may be located adjacent to a touch interface (see, e.g., touch interface 205 shown in FIGS. 2A and 2B) and the combination of the touch interface and display 606 may function as a touch screen.

Electronic paper display 606 can include microcapsules with charged particles. For example, display 606 can include microcapsule 610 with charged white particles 612 and charged black particles 614 as well as microcapsule 615 with charged white particles 617 and charged black particles 619 (see, e.g., microcapsule 410, white particles 412 and black particles 414, each of which is shown in FIG. 4A). In some embodiments, microcapsules in display 606 may be oriented vertically with a relatively elongated shape. In embodiments where an electronic paper display can be configured to be translucent by pulling particles within the display's microcapsules to the side, it may be advantageous to use vertically elongated microcapsules because such microcapsules may have a larger side wall and, therefore, particles can form a thinner layer along the side wall that is less visible to a user. In some embodiments, an electronic paper display may include electrical conductors extending between the microcapsules for repel or attracting colored particles within the microcapsules. For example, display 606 may include electrical conductors 620-623. As shown in FIG. 6B, display 606 can be configured to be translucent by applying an electric charge to electrical conductors 620-623. For example, a negative charge can be applied to electrical conductor 621 to attract positively-charged white particles 612 and 617 while repelling negatively-charged black particles 614 and 619. In some embodiments, alternating electrical charges can be applied to conductors 620-623 so that, while one conductor is repelling a certain type of particle (see, e.g., negatively-charged conductor 621 and negatively-charged black particles 614 and 619), an adjacent conductor is attracting that type of particle (see, e.g., positively-charged conductor 622 and negatively-charged black particles 619). In some embodiments, an electronic paper display that has been configured to be translucent may be selectively enabled by removing the charge from electrical conductors in the display. For example, a neutral charge (e.g., ground) can be applied to conductors 620-623 so that they do not exert any force on the colored particles. While FIGS. 6A and 6B show relatively wide electrical conductors (e.g., a width that is approximately one third that of the microcapsules), it is understood that narrower electrical conductors may be advantageous because they may allow for higher microcapsule density.

Figure 7:
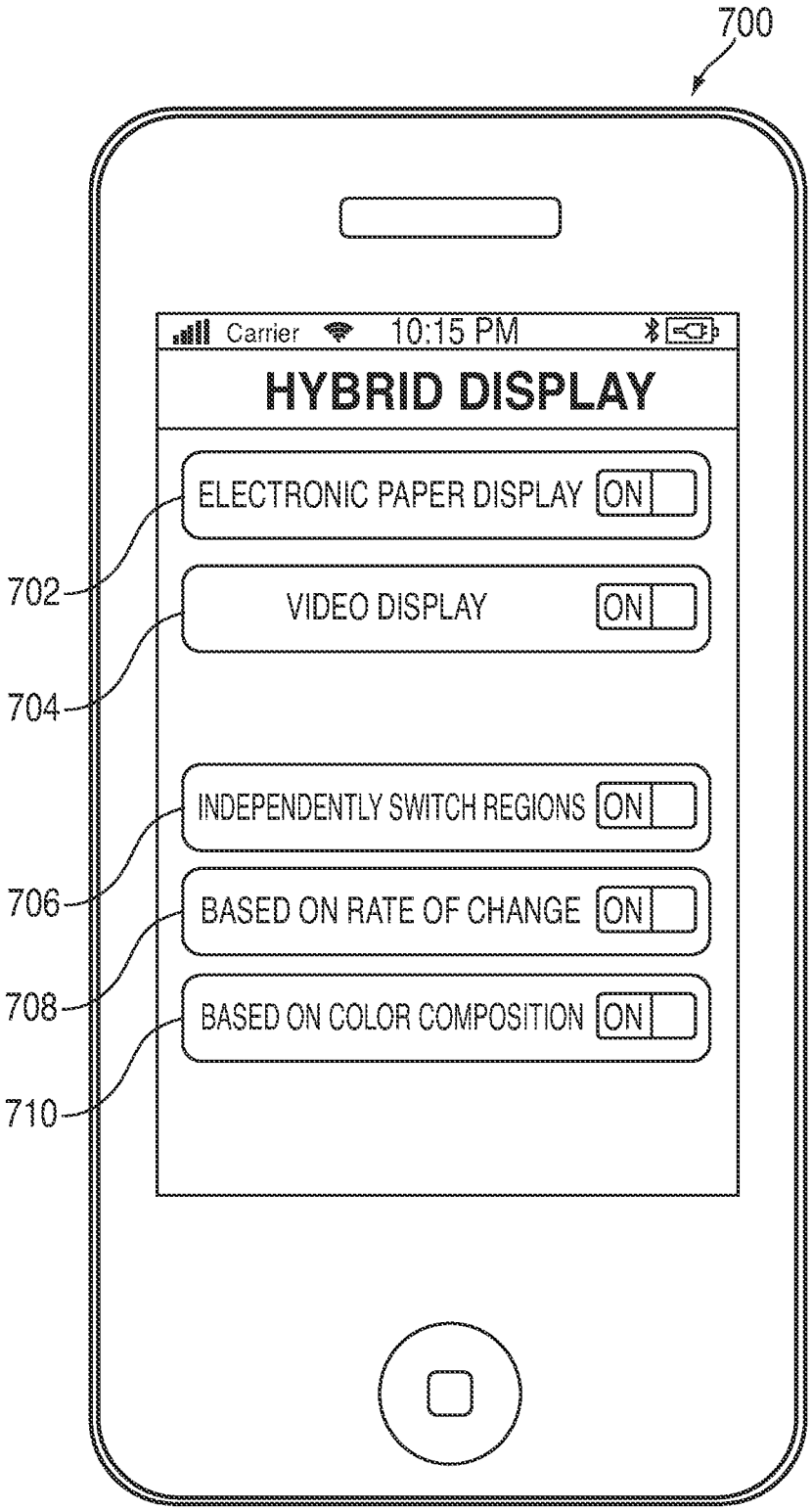
FIG. 7 is a schematic view of an illustrative display for configuring a device to switch between electronic paper and video displays in accordance with one embodiment of the invention.

In some embodiments, a user can configure a system to specify if and how a device switches between an electronic paper display and a video display. A user may be able to configure any aspect of determining one or more features of visual content and switching between displays based on the one or more determined features. For example, a user may be able to specify which feature of the visual content can be the basis for switching between displays. FIG. 7 is a schematic view of an illustrative display for configuring a device to switch between electronic paper and video displays in accordance with one embodiment of the invention. Screen 700 can be provided by an electronic device (e.g., device 100 shown in FIG. 1). Screen 700 can be provided through an electronic paper display (e.g., electronic paper display 106 shown in FIG. 1) or a video display (e.g., video display 107 shown in FIG. 1). An electronic device can provide display screen 700 as part of the device's configuration options. In some embodiments, an electronic device can provide screen 700 when a user accesses the configuration options for displays. Screen 700 can include options for switching between an electronic paper display and a video display based on one or more determined features of visual content. As seen in FIG. 7, screen 700 can include a title such as "Hybrid Display" to represent, in lay terms, the features associated with configuration screen 700. Option 702 can correspond to enabling an electronic paper display. If option 702 is switched off, the electronic device may not use an electronic paper display at all. For example, if option 702 is switched off, the electronic device may only use a video display to display visual content. If option 702 is switched on, the electronic device may enable the electronic paper display based on one or more features of visual content. Option 704 can correspond to enabling a video display. If option 704 is switched off, the electronic device may not use a video display at all. For example, if option 704 is switched off, the electronic device may only use an electronic paper display to display visual content. If option 704 is switched on, the electronic device may enable the video display based on one or more features of visual content.

In some embodiments, a configuration screen can include an option for specifying if an electronic device can independently switch regions of a composite display between portions of an electronic paper display and corresponding portions of a video display. For example, option 706 may correspond to independently switching regions of a composite display (see, e.g., device 300 shown in FIG. 3). If option 706 is turned off, the electronic device may not switch individual regions of a display based on a feature of visual content. For example, if option 706 is turned off, the electronic device may switch between an entire electronic paper display or an entire video display based on one or more features of visual content. If option 706 is turned on, the electronic device may independently switch regions of a composite display between portions of an electronic paper display and corresponding portions of a video display based on one or more features of visual content.

In some embodiments, a configuration screen can include options for specifying which features of visual content a device can determine before switching between electronic paper and video displays. Option 708 may correspond to the rate of change of visual content. Rate of change can include any suitable measure of change in visual content (e.g., new frames per second). For example, visual content's rate of change can be categorized as low (e.g., static text), high (e.g., dynamic video) or any other suitable category. Visual content's rate of change may be determined by control circuitry in an electronic device (see, e.g., control circuitry 101 shown in FIG. 1). For example, visual content's rate of change can be determined by graphics circuitry or a processor. If option 708 is turned off, the electronic device may not switch displays based on the visual content's rate of change. If option 708 is turned on, the electronic device may determine visual content's rate of change and then switch between displays based on the determined rate of change. For example, the electronic device may display relatively static content on an electronic paper display and relatively dynamic content on a video display.

Option 710 may correspond to the color composition of visual content. Color composition can include any suitable measure of the color in visual content. For example, the color composition of visual content can be categorized as black-and-white, grayscale, color or any other suitable category. The color composition of visual content may be determined by control circuitry in an electronic device (see, e.g., control circuitry 101 shown in FIG. 1). For example, color composition of visual content can be determined by graphics circuitry or a processor. If option 710 is turned off, the electronic device may not switch displays based on the visual content's color composition. If option 710 is turned on, the electronic device may determine the color composition of visual content and then switch between displays based on the determined color composition. For example, the electronic device may display black-and-white or grayscale content on an electronic paper display and color content on a video display.

While the embodiment shown in FIG. 7 includes options 708 and 710 corresponding to particular features of visual content for switching between electronic paper and video displays, it is understood that any suitable feature of visual content or any combination thereof can be the basis for switching between electronic paper and video displays.

Figure 8:
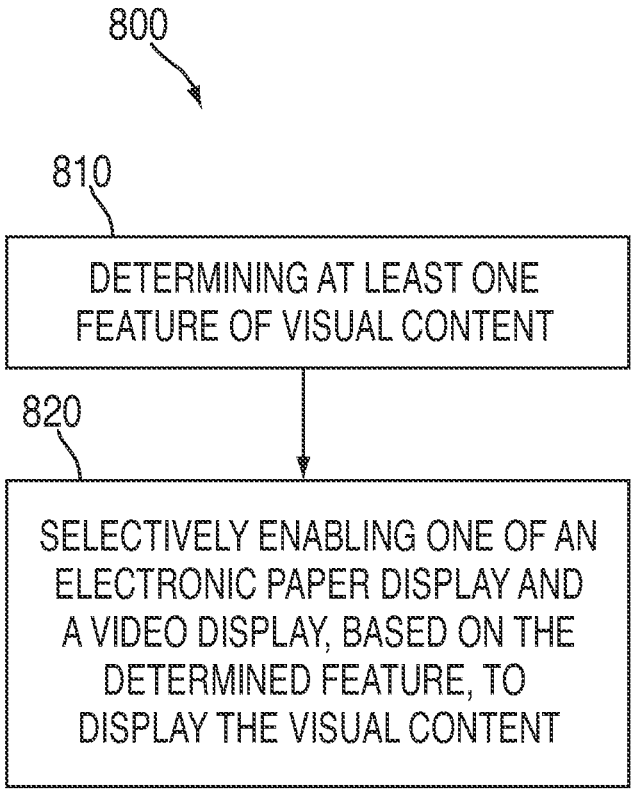
FIG. 8 is a flowchart of an illustrative process for switching between electronic paper and video displays in accordance with one embodiment of the invention.

FIG. 8 is a flowchart of illustrative process 800 for switching between an electronic paper display and a video display in accordance with one embodiment of the invention. Process 800 can be performed by any suitable electronic device (e.g., device 100 shown in FIG. 1, device 200 shown in FIGS. 2A and 2B or device 300 shown in FIG. 3). Process 800 can begin with block 810.

At block 810, one or more features of visual content can be determined. For example, a device can determine visual content's rate of change and/or color composition. As previously described, any suitable feature of visual content can be determined in accordance with the disclosure. A feature of visual content can be determined using any suitable circuitry within the device. For example, graphics circuitry or a processor may determine the visual content's rate of change by monitoring display driver signals.

At block 820, one of an electronic paper display and a video display can be selectively enabled, based on the determined feature, to display the visual content. As previously described, a device can enable either an electronic paper display or a video display to display the visual content. The device may use the determined at least one feature to enable the most appropriate device for the visual content. For example, if the determined feature indicates that the visual content is relatively dynamic, the device may enable the video display. In another example, if the determined feature indicates that the visual content has a low color composition, the device may enable the electronic paper display.

In some embodiments, process 800 may further include configuring at least a portion of the electronic paper display to be translucent. For example, if the video display is enabled at block 820, the device can configure at least a portion of the electronic paper display to be translucent so that the video display is visible to a user.

Figure 9:
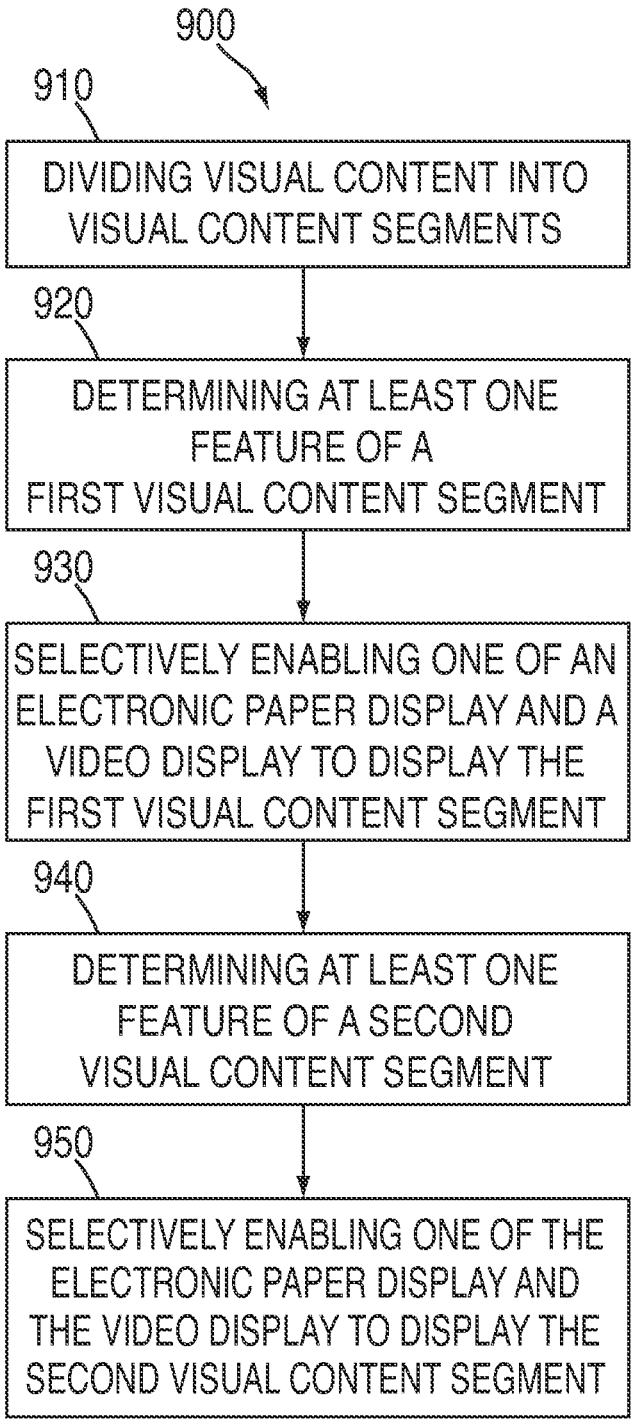
FIG. 9 is a flowchart of an illustrative process for switching between electronic paper and video displays in accordance with one embodiment of the invention.

FIG. 9 is a flowchart of illustrative process 900 for switching between an electronic paper display and a video display in accordance with one embodiment of the invention. Process 900 can be performed by any suitable electronic device (e.g., device 100 shown in FIG. 1, device 200 shown in FIGS. 2A and 2B or device 300 shown in FIG. 3). Process 900 can begin with block 910. In some embodiments, process 900 can be performed by an electronic device that includes a composite display with multiple regions (e.g., device 300 shown in FIG. 3).

At block 910, visual content can be divided into visual content segments. For example, a device can divide visual content into multiple segments and each segment can correspond to a region of a display. As previously discussed in connection with FIG. 3, visual content can be divided using any suitable technique into any suitable number of segments.

At block 920, at least one feature of a first visual content segment can be determined. For example, a device can determine the first segment's rate of change and/or color composition. As previously described, any suitable feature of a visual content segment can be determined in accordance with the disclosure. A feature of a visual content segment can be determined using any suitable circuitry within the device. For example, graphics circuitry or a processor may determine the segment's rate of change by monitoring display driver signals.

At block 930, one of an electronic paper display and a video display can be selectively enabled to display the first visual content segment. As previously described, a device can enable either an electronic paper display or a video display to display the visual content.

The device may use the determined at least one feature to enable the most appropriate device for the visual content. For example, if the determined feature indicates that the visual content is relatively dynamic, the device may enable the video display. In another example, if the determined feature indicates that the visual content has a low color composition, the device may enable the electronic paper display. The enabled display may provide the first segment of the visual content. In some embodiments, only a portion of the display may be enabled (e.g., a panel of a video display).

At block 940, at least one feature of a second visual content segment can be determined. With the exception of the second visual content segment, block 940 may be substantially similar to block 920 and the previous description of the latter can be applied to the former.

At block 950, one of an electronic paper display and a video display can be selectively enabled to display the second visual content segment. With the exception of the second visual content segment, block 950 may be substantially similar to block 930 and the previous description of the latter can be applied to the former. In some embodiments, different display may be enabled for displaying different visual content segments. For example, the electronic paper display may be enabled for displaying the first visual content segment while the video display may be enabled for displaying the second visual content segment. Accordingly, each visual content segment can be displayed on the most appropriate display for that segment.

In some embodiments, process 900 may further include configuring at least a portion of the electronic paper display to be translucent. For example, if the video display is enabled at block 930 or block 950, the device can configure at least a portion of the electronic paper display to be translucent so that the video display is visible to a user.

Figure 10:
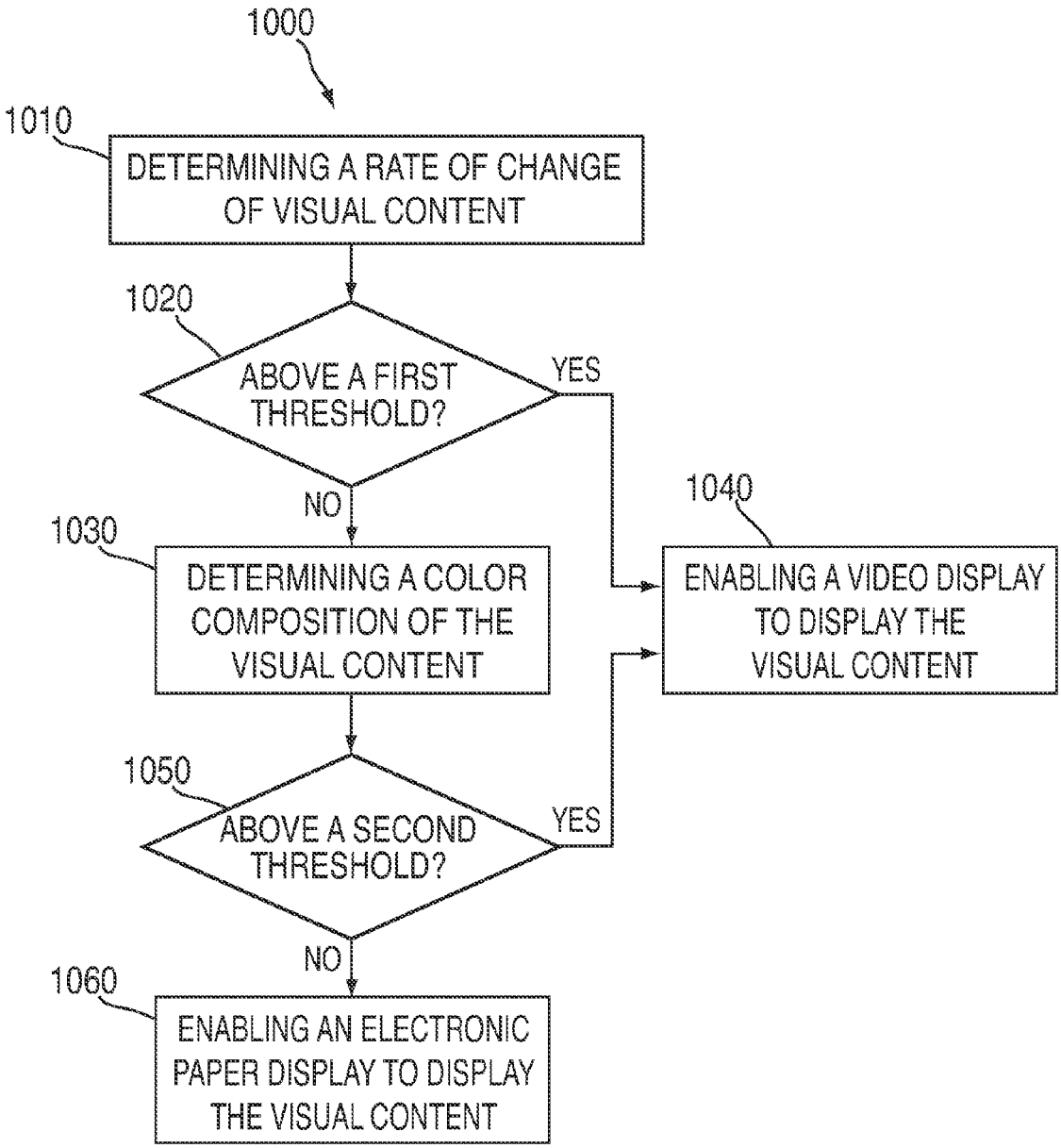
FIG. 10 is a flowchart of an illustrative process for switching between electronic paper and video displays in accordance with one embodiment of the invention.

FIG. 10 is a flowchart of illustrative process 1000 for switching between an electronic paper display and a video display in accordance with one embodiment of the invention. Process 1000 can be performed by any suitable electronic device (e.g., device 100 shown in FIG. 1, device 200 shown in FIGS. 2A and 2B or device 300 shown in FIG. 3). Process 1000 can begin with block 1010.

At block 1010, a rate of change of visual content can be determined. For example, a device can determine if the visual content is relatively static or dynamic. The rate of change of visual content can be determined using any suitable circuitry within the device. For example, graphics circuitry or a processor may determine the visual content's rate of change by monitoring display driver signals.

At decision node 1020, a device can determine whether the rate of change is above a first threshold. For example, a device can compare the rate of change to a threshold to determine if the visual content is relatively static (e.g., below the threshold) or relatively dynamic (e.g., above the threshold). If the rate of change is above the first threshold, process 1000 can proceed to block 1040. At block 1040, a video display can be enabled to display the visual content. As previously described, a device can use the rate of change to enable the most appropriate device for the visual content. For example, the video display may be the most appropriate device for displaying dynamic visual content. It may be disadvantageous to use an electronic paper display to display such content because the energy savings typically associated with electronic paper displays may be mitigated when the display changes often.

Returning to decision node 1020, process 1000 can proceed to block 1030 if the rate of change is not above the first threshold. At block 1030, a color composition of the visual content can be determined. For example, a device can determine if the visual content is black-and-white, grayscale or color. The color composition of visual content can be determined using any suitable circuitry within the device. For example, graphics circuitry or a processor may determine the visual content's color composition by monitoring display driver signals.

At decision node 1050, a device can determine whether the color composition is above a second threshold. For example, a device can compare the color composition to a threshold to determine if the visual content has a black-and-white or grayscale color composition (e.g., below the threshold) or a relatively complex color composition (e.g., above the threshold).

If the color composition is above the first threshold, process 1000 can proceed to block 1040. As previously described, a device can use the color composition to enable the most appropriate device for the visual content. For example, the video display may be the most appropriate device for displaying visual content with a complex color composition that includes many different colors. It may be disadvantageous to use an electronic paper display to display such content because electronic paper displays typically have limited color range.

Returning to decision node 1050, process 1000 can proceed to block 1060 if the color composition is not above the first threshold. At block 1060, an electronic paper display can be enabled to display the visual content. As previously described, a device can selectively enable an electronic paper display to display visual content if the visual content is relatively static and has a simple color composition (e.g., black-and-white or grayscale). It can be advantageous to provide such visual content through an electronic paper display because the display can operate in a more energy-efficient manner and cause less strain to a user's eyes than a video display.

In some embodiments, process 1000 may further include configuring at least a portion of the electronic paper display to be translucent. For example, if the video display is enabled at block 1040, the device can configure at least a portion of the electronic paper display to be translucent so that the video display is visible to a user.

In some embodiments, process 1000 may further include dividing visual content into multiple segments that each correspond to a region of a composite display. For example, a device can divide visual content into multiple segments, determine the rate of change and/or color composition of each segment, and then enable either a video display or an electronic paper display accordingly.

The various embodiments of the invention may be implemented by software, but can also be implemented in hardware or a combination of hardware and software. The invention can also be embodied as computer readable code on a computer readable medium. The computer readable medium can be any data storage device that can store data which can thereafter be read by a computer system. Examples of a computer readable medium include read-only memory, random-access memory, CD-ROMs, DVDs, magnetic tape, and optical data storage devices. The computer readable medium can also be distributed over network-coupled computer systems so that the computer readable code is stored and executed in a distributed fashion.

The above described embodiments of the invention are presented for purposes of illustration and not of limitation.

What is claimed is:

1. An electronic device comprising:

a processor;

an electronic paper display electrically coupled with the processor and comprising:

a plurality of microcapsules; and an electrical conductor disposed between a first pair of the plurality of microcapsules; and a video display electrically coupled with the processor and stacked with the electronic paper display such that, when the video display is enabled, at least a portion of the video display is viewable by a user through a least a portion of the electronic paper display, wherein the processor is operative to:

determine at least one feature of visual content; and selectively enable at least one of the electronic paper display and the video display, based on the at least one determined feature, to display the visual content, wherein the electrical conductor is operative to attract particles in the first pair of microcapsules to side walls of the first pair of microcapsules if the video display is enabled, wherein the at least one feature of the visual content comprises a color composition of the visual content, and wherein the processor is operative to:

selectively enable the electronic paper display to display to display the visual content if the color composition is below a threshold , and selectively enable the video display to display the visual content if the color composition is above a threshold.

2. The device of claim 1, wherein the electronic paper display is stacked over the video display.

3. The device of claim 2, wherein the electronic paper display is operative to configure at least a portion of itself to be translucent if the video display is enabled.

4. The device of claim 1, wherein:

the at least one feature of the visual content comprises a rate of change of the visual content; and the processor is operative to:

selectively enable the electronic paper display to display the visual content if the rate of change is below a threshold; and selectively enable the video display to display the visual content if the rate of change is above a threshold.

5. The device of claim 1, wherein:

the electronic paper display comprises a plurality of electronic paper display regions;

the video display comprises a plurality of video display regions, each of which is electrically coupled with the processor;

each of the video display regions is stacked with a respective one of the electronic paper display regions to form a plurality of composite display regions; and the processor is operative to:

divide the visual content into a plurality of content segments, wherein each of the plurality of content segments corresponds to a respective one of the plurality of composite display regions;

determine at least one feature of a first segment of the plurality of content segments, the first segment corresponding to a first region of the plurality of composite display regions; and selectively enable, based on the at least one determined feature, at least one of the first region's electronic paper display region and the first region's video display region.

6. The device of claim 5, wherein the plurality of video display regions comprises a plurality of video display panels.

7. The device of claim 5, wherein each of the plurality of electronic display regions is operative to configure itself to be translucent if the corresponding video display region is enabled.

8. The device of claim 1, wherein the at least one feature of the visual content comprises:

a rate of change of the visual content.

9. An electronic device comprising:

a processor;

an electronic paper display electrically coupled with the processor and comprising:

a plurality of microcapsules; and an electrical conductor disposed between a first pair of the plurality of microcapsules; and a video display electrically coupled with the processor and stacked with the electronic paper display such that, when the video display is enabled, at least a portion of the video display is viewable by a user through a least a portion of the electronic paper display, wherein the processor is operative to:

distinguish first content having a color composition above a threshold from second content having a color composition below the threshold;

selectively enable the electronic paper display to display the second content; and selectively enable the video display to display the first content, wherein the electrical conductor is operative to attract particles in the first pair of microcapsules to side walls of the first pair of microcapsules if the video display is enabled.

10. The device of claim 9, wherein:

a first region of the electronic paper display overlaps a first region of the video display; and the processor is further operative to configure the first region of the electronic paper display to be substantially translucent if the first region of the video display is enabled.

11. The device of claim 10, wherein the first region of the electronic paper display comprises:

a plurality of microcapsules; and an electrical conductor disposed between a first pair of the plurality of microcapsules, wherein the electrical conductor is operative to attract particles in the first pair of microcapsules to side walls of the first pair of microcapsules if the video display is enabled.

12. The device of claim 9, wherein:

the electronic paper display comprises a plurality of electronic paper display regions;

the video display comprises a plurality of video display regions, each of the video display regions being associated with an electronic paper display region; and the processor is operative to:

divide visual content into a plurality of segments, each of the segments being associated with an electronic paper display region and a video display region;

for each of the plurality of segments, distinguish dynamic visual content having a rate of change above a threshold from static visual content having a rate of change below a threshold;

selectively enable at least one electronic paper display region to display static visual content associated with the at least electronic display region; and selectively enable at least one video display region to display dynamic visual content associated with the video display region.

13. A method for switching between an electronic paper display and a video display, the method comprising:

determining whether visual content has a color composition above or below a threshold; and selectively enabling one of an electronic paper display and a video display, based on whether the color composition of the visual content is above or below the threshold, to display the visual content, wherein:

the electronic paper display is stacked over the video display in an electronic device such that, when the video display is enabled, at least a portion of the video display is viewable by a user through a least a portion of the electronic paper display.

14. The method of claim 13, further comprising:

configuring at least a portion of the electronic paper display to be translucent if the video display is enabled.

15. The method of claim 13, wherein selectively enabling one of an electronic paper display and a video display to display the visual content comprises: transmitting a display signal to the electronic paper display if a rate of change of the visual contents is below a threshold; and transmitting a display signal to the video display if the rate of change is above the threshold.

16. The method of claim 13, wherein selectively enabling one of an electronic paper display and a video display to display the visual content comprises:

transmitting a display signal to the electronic paper display if the color composition is below a threshold; and transmitting a display signal to the video display if the color composition is above a threshold.

17. A method for switching between an electronic paper and a video display, the method comprising:

dividing visual content into a plurality of visual content segments, wherein each of the plurality of visual content segments corresponds to a region of a composite display;

determining whether of a first visual content segment of the plurality of visual content segments has a color composition that is above or below a threshold, wherein:

the first visual content segment corresponds to a first region of the composite display;

in response to determining whether the color composition of the first visual content segment is above or below the threshold, selectively enabling one of an electronic paper display and a video display to display the first visual content segment;

determining at least one feature of a second visual content segment of the plurality of visual content segments, wherein: the second visual content segment corresponds to a second region of the composite display; and the at least one feature of the second visual content segment comprises a rate of change of the second visual content segment and a color composition of the second visual content segment; and in response to determining the at least one feature of the second visual content segment, selectively enabling one of the electronic paper display and the video display to display the second visual content segment, wherein the video display is stacked with the electronic paper display in an electronic device such that, when the video display is enabled, at least a portion of the video display is viewable by a user through a least a portion of the electronic paper display.

18. The method of claim 17, further comprising:

in response to selectively enabling the video display, configuring at least a portion of the electronic paper display to be translucent.

19. A method for switching between an electronic paper display and a video display, the method comprising:

determining a rate of change of visual content;

in response to determining that the rate of change is above a first threshold, enabling a video display to display the visual content;

determining a color composition of the visual content;

in response to determining that the color composition the visual content is above a second threshold, enabling the video display to display the visual content; and in response to determining that the rate of change is below the first threshold and the color composition is below the second threshold, enabling an electronic paper display to display the visual content, wherein the video display is stacked with the electronic paper display in an electronic device such that, when the video display is enabled, at least a portion of the video display is viewable by a user through a least a portion of the electronic paper display.

20. A non-transitory computer readable storage medium for an electronic device, the computer readable storage medium comprising:

a first instruction code for determining at least one feature of visual content;

wherein the at least one feature of the visual content comprises a rate of change of the visual content and a color composition of the visual content;

a second instruction code for determining whether the color composition of the visual content is above or below a threshold;

a third instruction code for selectively enabling one of an electronic paper display and a video display that are stacked together in the electronic device, based on the determined feature and based on whether the color composition of the visual content is above or below the threshold , to display the visual content; and a fourth instruction code for configuring, in response to enabling the video display, at least a portion of the electronic paper display to be translucent such that at least a portion of the video display is viewable by a user through a least a portion of the electronic paper display.

* * * * *

UNITED STATES PATENT AND TRADEMARK OFFICE

CERTIFICATE OF CORRECTION

PATENT NO. : 8,760,363 B2
APPLICATION NO. : 12/572204
DATED : June 24, 2014
INVENTOR(S) : Gloria Lin et al.

It is certified that error appears in the above-identified patent and that said Letters Patent is hereby corrected as shown below:

In the Claims

In claim 19, column 18, line 33, delete "determining that the color composition the visual content" and insert -- determining that the color composition of the visual content --

Signed and Sealed this
Twenty-eighth Day of October, 2014

Michelle K. Lee

Michelle K. Lee
*Deputy Director of the United States Patent and Trademark Office*